US005505341A

United States Patent [19]

Gueret

[11] Patent Number: 5,505,341

[45] Date of Patent: Apr. 9, 1996

[54] DISPENSING ASSEMBLY WITH A VARIABLE-VOLUME COMPRESSION CHAMBER AND WITH A DIAPHRAGM

[75] Inventor: Jean-Louis H. Gueret, Paris, France

[73] Assignee: L'Oreal, Paris, France

[21] Appl. No.: 323,835

[22] Filed: Oct. 17, 1994

[30] Foreign Application Priority Data

Oct. 22, 1993 [FR] France ..... 93 12642

[51] Int. Cl.[6] ..... B65D 37/00

[52] U.S. Cl. ..... 222/207; 222/209; 222/494

[58] Field of Search ..... 222/95, 105, 183, 222/207, 209, 211–213, 491, 494, 380, 383.1, 571

[56] References Cited

U.S. PATENT DOCUMENTS

| | | | |
|---|---|---|---|
| 2,884,164 | 4/1959 | Kleid | 222/207 |
| 2,923,441 | 2/1960 | McConnohie | 222/207 |
| 3,726,442 | 4/1973 | Davidson et al. | 222/207 |
| 3,986,644 | 10/1976 | Grogan et al. | 222/207 |
| 4,880,161 | 11/1989 | Wright | 222/209 |
| 5,161,718 | 11/1992 | Gueret | 222/494 |
| 5,271,432 | 12/1993 | Gueret | 222/207 |

FOREIGN PATENT DOCUMENTS

| | | |
|---|---|---|
| 0410858 | 1/1991 | European Pat. Off. . |
| 0549049 | 6/1993 | European Pat. Off. . |
| 2150226 | 6/1985 | United Kingdom . |

*Primary Examiner*—Andres Kashnikow
*Assistant Examiner*—Philippe Derakshani
*Attorney, Agent, or Firm*—Young & Thompson

[57] ABSTRACT

The dispensing assembly includes a container (8) holding the product, a dispensing head (20) having a dispensing channel (21), a flexible diaphragm (30) possessing a part in the form of a dome (32) which defines, in the dispensing head (20), a variable-volume compression chamber (50) in communication with the container (8); an inlet valve (133) is placed in this communication and allows the product to pass only from the container (1) to the compression chamber (50); the flexible diaphragm (30) is held against the dispensing head (20) by a fixing element consisting of a ring (40) possessing an opening (42) from which the compression dome (32) of the flexible diaphragm (30) emerges. The ring (40) bears an annular projection (41) surrounding the opening (42), the dispensing head (20) being provided with an annular groove (25) receiving an annular groove (34) which the flexible diaphragm (30) possesses and which surrounds the compression dome (32) of the flexible diaphragm (30), the annular projection (41) of the ring (40) being forcibly inserted into the annular groove (34) of the flexible diaphragm (30).

12 Claims, 3 Drawing Sheets

DISPENSING ASSEMBLY WITH A VARIABLE-VOLUME COMPRESSION CHAMBER AND WITH A DIAPHRAGM

The present invention relates to an assembly for dispensing a fluid product, in the form of a liquid or paste, enabling the product to be stored aseptically.

Many dispensing systems are known which include a container, holding the product to be dispensed, and a dispensing head having a dispensing channel communicating, on the one hand, with the container holding the product to be dispensed and, on the other hand, with the outside; a device carried by the dispensing head enables the user to dispense the product at will.

Dispensing assemblies are also known which have a variable-volume compression chamber in communication with the container; it has already been proposed to produce the compression chamber by means of a flexible diaphragm possessing a part in the form of a dome on which the user acts in order to dispense; of course, a fixing element is provided in order to fix the flexible diaphragm to the dispensing head, the fixing element consisting of a ring possessing an opening from which the compression dome of the flexible diaphragm emerges.

The subject of the present invention is a dispensing assembly of the above type in which the fixing of the flexible diaphragm, while still being simple, is very reliable.

Thus, according to the invention, an assembly for dispensing a liquid to pasty product, which includes a container holding the product, a dispensing head having a dispensing channel, a flexible diaphragm possessing a part in the form of a dome which defines, in the dispensing head, a variable-volume compression chamber in communication with the container, an inlet valve being placed in this communication and allowing the product to pass only from the container to the compression chamber, the said compression chamber, the inlet valve and a dispensing valve constituting a pump for dispensing product, the said flexible diaphragm being held against the dispensing head by a fixing element consisting of a ring possessing an opening from which the compression dome of the flexible diaphragm emerges, is characterized in that the ring bears an annular projection surrounding the said opening, the dispensing head being provided with an annular groove receiving an annular groove which the flexible diaphragm possesses and which surrounds the compression dome of the flexible diaphragm, the annular projection of the ring being forcibly inserted into the annular groove of the flexible diaphragm.

In order to further simplify the construction of the assembly, the inlet valve is advantageously moulded as a single piece with the flexible diaphragm.

It is known that, after dispensing the product, part of the latter remains in the dispensing channel; this part of the product is in contact with air during the air uptake by the dispensing head and during storage; the product may therefore be degraded by oxidation or contaminated by impurities in the air and, during subsequent dispensing, the product dispensed may have lost its intrinsic qualities, or indeed have become harmful.

Dispensing assemblies have already been proposed which include a closure system located at the terminal part, opening onto the outside, of the dispensing channel, the said system consisting of a seat and of a springy leaf at least partially in contact with the seat when there is no dispensing, moving away, at least partially, from the said seat by flexing under the pressure of the product to be dispensed and coming back, by elasticity, into its initial position when dispensing ceases; the closure system described hereinabove, with a springy leaf constituting a dispensing valve, when it is combined with an inlet valve, the assembly consisting of the variable-volume compression chamber and of these two, dispensing and inlet, valves, constitutes a pump for dispensing the product.

Advantageously, the dispensing valve, consisting of the springy leaf, is moulded as a single piece with the flexible diaphragm; thereafter, the fixing of the flexible diaphragm, according to the invention, makes it possible to seal both the compression chamber and the closure system at rest, by stressing the springy leaf against its seats it enables the product to be preserved under good conditions during the storage period.

Preferably, the dispensing head is mounted so as to rotate between at least two positions, a position in which a communication between the compression chamber and the container is closed and a position in which the said communication is open. This enables the product held in the container to be better isolated during storage.

Preferably, the assembly comprises a rigid bottle to which a support is fixed, the dispensing head being axially integral with the said support and free to rotate with respect to it; advantageously, the support possesses an internal cylindrical outer skirt housed in a sealed manner in the annular space lying between an internal tubular part and an external tubular part which the dispensing head possesses.

According to one embodiment, a port passes through the wall of the internal cylindrical outer skirt of the support, the internal and external tubular parts of the dispensing head being respectively provided with a longitudinal slot and with a passage, these facing each other, the passage emerging into the compression chamber and being able to be closed off by the inlet valve, the internal cylindrical inner skirt of the support and the internal tubular part of the dispensing head communicating with the container, the longitudinal slot and the passage being placed so as to face the port in that position of the dispensing head with respect to the support for which communication between the compression chamber and the container is open.

According to a first variant, the container is a flexible bag housed inside the rigid bottle and rendered integral, in a sealed manner, with a sleeve prolonging the internal cylindrical outer skirt of the support towards the inside of the bottle, the bottom of the rigid bottle including an air-uptake orifice.

According to another variant, the container is the rigid bottle and the assembly comprises a dip tube going down to near the lower part of the rigid bottle and being connected, in its upper part, to the internal cylindrical outer skirt of the support.

The invention will be better understood with reference, in an illustrative but non-limiting manner, to the appended drawings in which.

Figure 2:
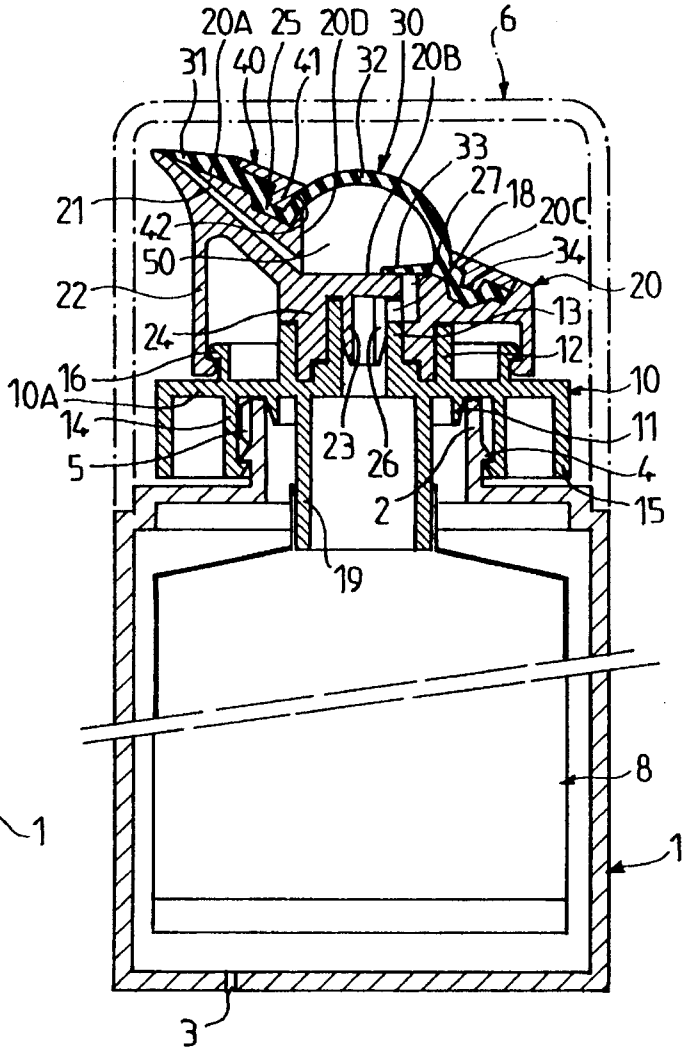
FIG. 2 is a sectional partial view on a larger scale of the assembly of FIG. 1.
Figure 1:
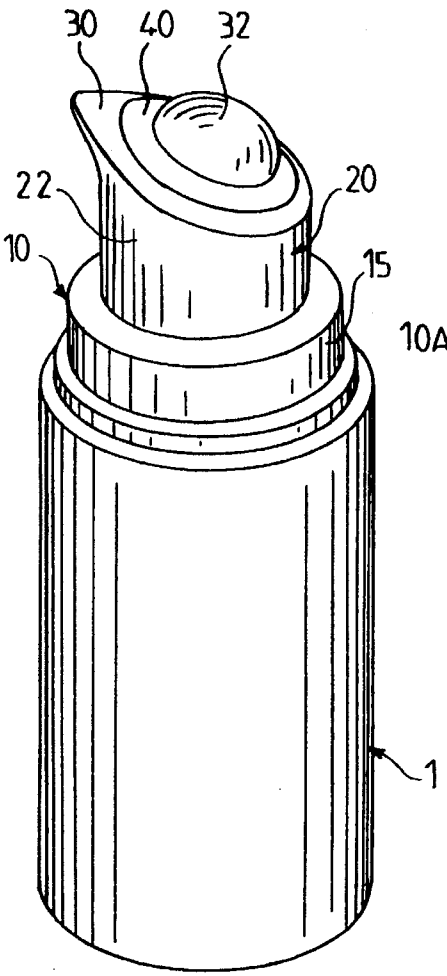
FIG. 1 is a perspective general view showing a dispensing assembly according to the invention.

Referring to FIGS. 1 and 2, a dispensing assembly according to the invention comprises a rigid bottle 1 having a neck 2 bearing a snap-fastening shoulder 4 at its outer periphery.

The bottle 1 is designed to receive a support 10 for a dispensing head 20.

The support 10 possesses concentric cylindrical skirts of circular cross-section extending from a transverse wall 10A, on either side of said wall; the said skirts extend with respect to this wall 10A either towards the bottle 1, in which case they are called inner skirts, or from the side opposite the bottle 1, in which case they are called outer skirts; thus, the support 10 possesses two outer skirts, namely an external skirt 12 and an internal skirt 13, and two inner skirts, namely an external skirt 15 and an internal skirt 14; the internal inner skirt 14 possesses, in its lower part, a snap-fastening shoulder interacting with the snap-fastening shoulder 4 of the neck 2 of the bottle 1 in order to render the support axially integral with the bottle 1; furthermore, anti-rotation fins 5, placed axially between the neck 2 and the said internal inner skirt 13, also prevent the support 10 from rotating with respect to the bottle 1; the support 10 and the bottle 1 are rendered integral in a sealed manner by virtue of an annular sealing lip 11 borne by the support 10 and applied against the upper edge of the neck 2 of the bottle 1.

The dispensing head 20 has a cylindrical general shape of revolution with a truncated upper part; more precisely, the dispensing head 20 possesses a cylindrical outer case 22, of circular cross-section, the lower part of which is snap-fastened onto a snap-fastening ring 16 borne by the support 10; by virtue of this arrangement, the dispensing head 20 is held in place axially with respect to the same support 10 while still being able to rotate with respect to the said support 10.

At the upper part, the dispensing head 20 possesses a plane bearing surface 20A extending in a plane perpendicular to the plane of FIG. 2 and inclined to the axis of the bottle 1; this plane is interrupted at the centre of the dispensing head 20 by a hollowed region 50 bordered by a semi-cylindrical wall 20A extending down to a transverse bottom 20B and intended, as described hereinbelow, to form a compression chamber 50.

The dispensing head includes two tubular parts extending towards the support 10, an external tubular part 24 and an internal tubular part 23; the internal cylindrical outer skirt 13 of the support 10 is housed in a sealed manner in the annular space lying between the said internal 23 and external 24 tubular parts; likewise, the external tubular part 24 of the dispensing head 20 is housed in a sealed manner in the annular space lying between the internal 13 and external 12 outer skirts of the support 10; this baffle-type mounting ensures good sealing of the chamber 50 with respect to the support 10, despite the dispensing head 20 being mounted so as to rotate on the said support 10.

In the example depicted in FIGS. 1 and 2, the container holding the product to be dispensed is a flexible bag 8 housed inside the bottle 1 and rendered integral, in a sealed manner, for example by heat-sealing, with a sleeve 19 of the support 10, this sleeve extending from the transverse wall 10A and prolonging the internal outer skirt 13 of the support 10 towards the bottle 1.

The dispensing head 20 is mounted so as to rotate with respect to the support 10 between at least two positions: a position in which communication between the chamber 50 and the inside of the flexible bag 8 is closed, and a position where the said communication is open; for this purpose, a port 18 passes through the wall of the internal outer skirt 13 of the support 10 and the internal 23 and external 24 tubular parts of the dispensing head 20 are respectively provided with a longitudinal slot 26 and with a passage 27, these facing each other; the passage 27 emerges into the chamber 50 in line with the bottom 20B. With the internal outer skirt 13 of the support 10 and the internal tubular part 23 of the dispensing head 20 communicating with the bag 8, when the longitudinal slot 26 and the passage 27 are placed so as to face the port 18, as is depicted in FIG. 2, communication is established between the chamber 50 and the bag 8; when the dispensing head 20 is rotated, with respect to the support 10, so that this coincidence no longer occurs, the said communication is closed.

The dispensing head 20 bears, at its upper part, a flexible diaphragm 30 covering the plane part 20A of the dispensing head 20; at its highest end, the flexible diaphragm 30 has a bevelled profile defining a springy leaf 31 applied against the end of the plane part 20A into which that terminal part, opening onto the outside, of a dispensing channel 21 passing through the dispensing head 20 emerges and the other end of which dispensing channel emerges into the chamber 50; the said chamber 50 is bordered on the outside by a dome 32 which possesses the diaphragm 30 in line with the bottom 20B; the flexible diaphragm 30 possesses an annular groove 34, surrounding the base of the dome 32, which is received in a corresponding annular groove 25 hollowed out in the plane part 20A of the dispensing head 20; this arrangement enables the diaphragm 30 to be perfectly positioned with respect to the dispensing head 20 and especially the springy leaf 31; it also enables the diaphragm 30 to be effectively fixed; for this purpose, in accordance with the invention, a ring 40 possessing an opening 42 for the passage of the dome 32 possesses an annular projection 41 forcibly fitted into the annular groove 34 of the diaphragm 30; with the ring 40 thus having a generally L-shaped cross-section, it possesses a collar extending parallel to the plane bearing surface 20A, especially in line with the springy leaf 31, and which acts as a member for stressing the leaf 31 applied against its seat 20A, thus ensuring perfect sealing, at rest, of the closure of the dispensing channel 21 with respect to the outside.

Figure 10:
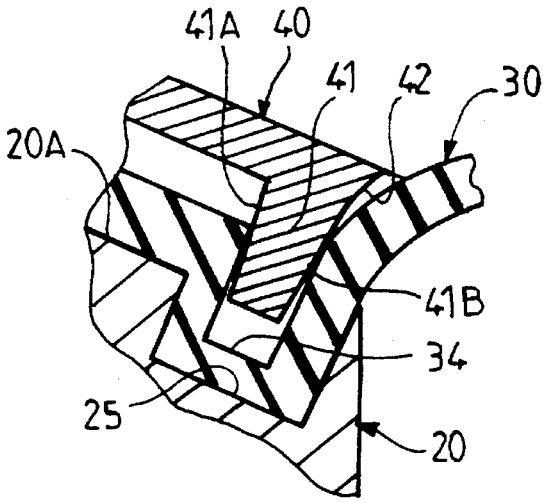
FIG. 10 is a sectional partial view on a large scale illustrating the fixing of the diaphragm by the ring.
Figure 11:
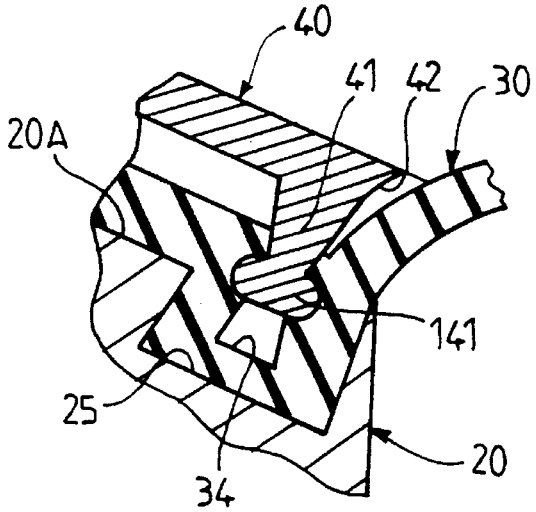
FIG. 11 is similar to FIG. 10 and illustrates an alternative fixing embodiment.

In FIGS. 10 and 11 may be seen examples of profiles of annular grooves 25 and 34 and of an annular projection 41 which have given good results; according to the alternative embodiment of FIG. 10, the annular groove 25 with which the dispensing head 20 is provided has a generally rectangular-shaped cross-section and receives a part of complementary shape of the flexible diaphragm 30 defining a groove 34 also having a generally rectangular-shaped cross-section; the annular projection 41 of the ring 40 is bordered by annular faces 41A, 41B which, on going towards the plane part 20A of the dispensing head 20, are slightly conical; the angle of the cone is, for example, the taper angle usually employed in moulding technology. According to the alternative embodiment of FIG. 11, the annular groove 25 has a generally trapezium-shaped cross-section, the large base of which is on the side of the bottom of the groove 25; the groove 34 of the flexible diaphragm 30 has a complementary shape, also trapezoidal, and the annular projection 41 of the ring 40 bears, at its free end, an annular protuberance 141 which, when the ring 40 is in place, creates a component of transverse force gripping the side walls of the groove 34 of the diaphragm 30 against the reverse-tapered side walls of the groove 25 of the dispensing head 20.

Figure 9:
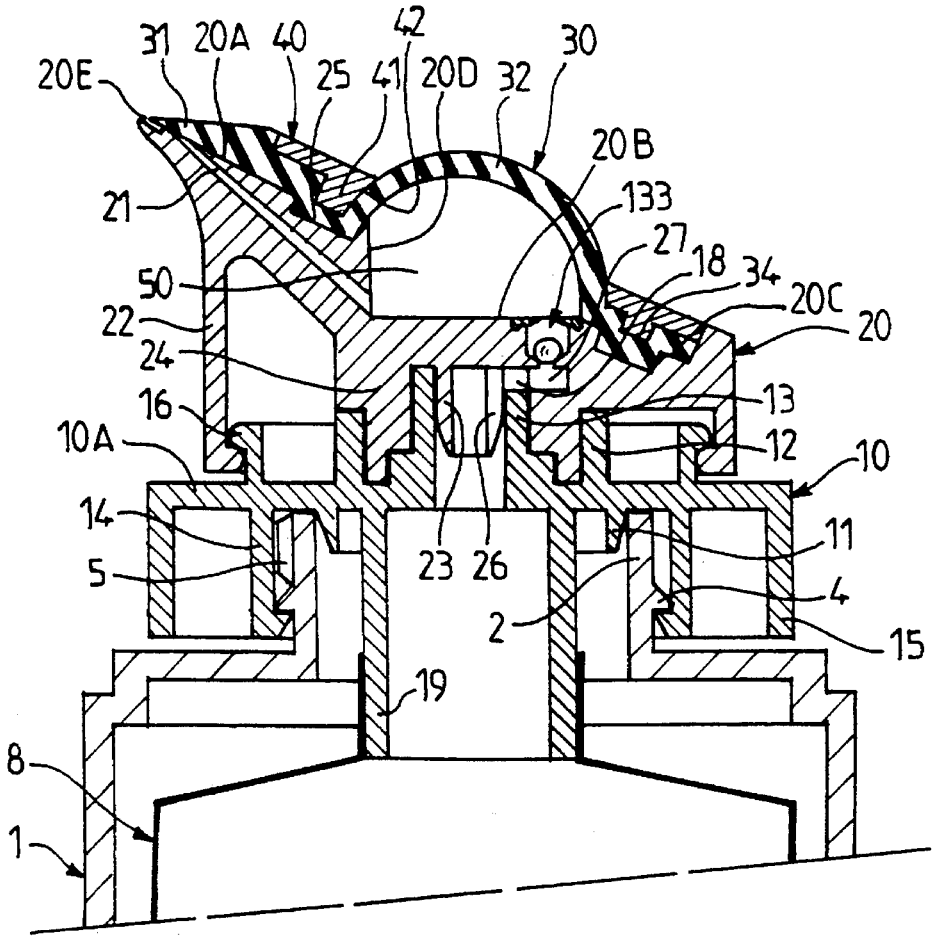
FIG. 9 is a sectional partial view of an alternative embodiment of the dispensing assembly according to FIG. 2, on a larger scale than that of FIG. 2.

By arranging, in line with the passage 27, an inlet valve 33 allowing only the product contained in the bag 8 to pass towards the chamber 50, a dispensing pump is thus formed in a simple manner, the springy leaf 31 acting as the dispensing valve associated with the variable-volume chamber 505 this simplicity is enhanced when, as shown in FIG. 2, the valve 33 is moulded as a single piece with the springy diaphragm 30; since the annular bearing surface 41 is designed to be off-centre with respect to the opening 42, a bearing surface 20C is thus provided in line with the root of the valve 33, this bearing surface stressing the valve 33 in application against its seat 20B, thus improving the efficiency of the dispensing. However, the inlet valve may, of course, be independent of the diaphragm 30, as shown in FIG. 9 in which the said valve is formed by a ball valve 133 arranged in the passage 27; the presence may also be noted in this figure of a U-shaped channel 20E hollowed out in the plane bearing surface 20A of the dispensing head 20 downstream of the dispensing channel 21; the channel 20E enables the product at the outlet of the dispensing channel 21 to be guided, this guiding being all the more useful the more liquid the product dispensed.

The bottom of the bottle 1 is pierced with an air-uptake orifice 3 making it easier for the flexible bag 8 to shrink progressively with the dispensing of the product which it contains; at rest, after use, the product fills the bag 8 and the chamber 50; after having removed the overcap 6 which the assembly comprises and after putting the dispensing head 20 into the position which it occupies in FIG. 2, pressure exerted on the dome 32 pushes the product through the dispensing channel 21, which product lifts up the leaf 31 and is dispensed; when the action on the dome 32 ceases, the leaf 31 comes back onto its seat; during the return movement of the dome 32 towards its rest position, the valve 33 is lifted up, allowing the product to pass towards the chamber 50; the bag 8 follows this product transfer without constraint, on account of the air let in via the orifice 3. When putting the assembly into storage, the dispensing head 20 is rotated with respect to the support 10 until the communication between the chamber 50 and the bag 8 is closed; the overcap 6 is then put in place and the product is stored completely safely.

Figure 3:
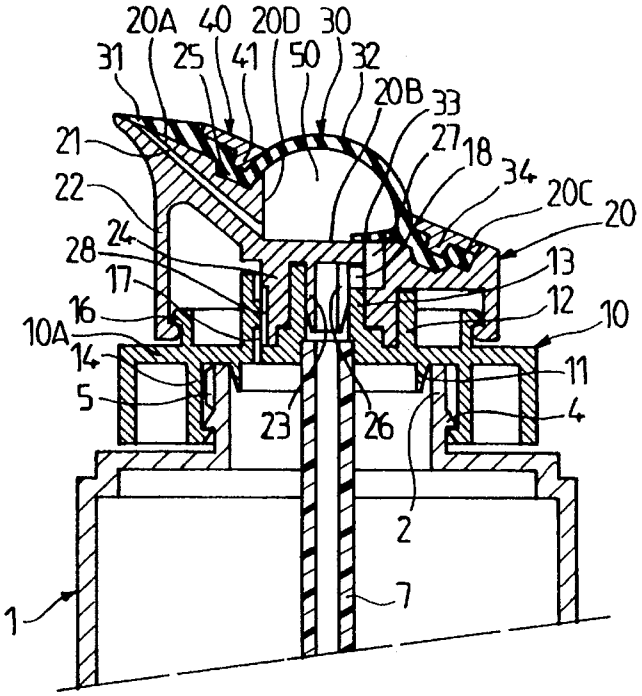
FIG. 3 is a sectional partial view of an alternative embodiment of an assembly according to the invention.
Figure 4:
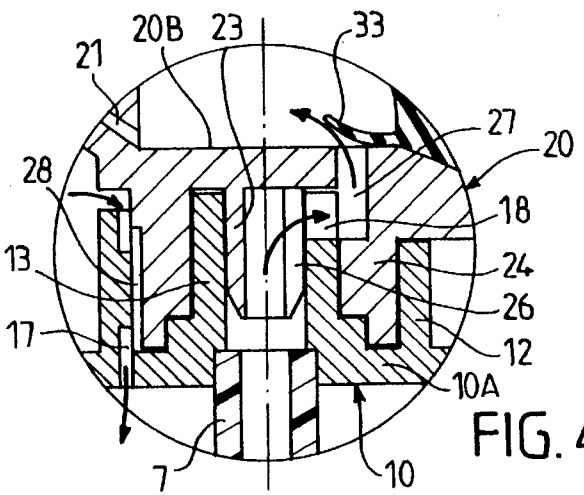
FIG. 4 is a sectional partial view on a larger scale of part of FIG. 3.
Figure 5:
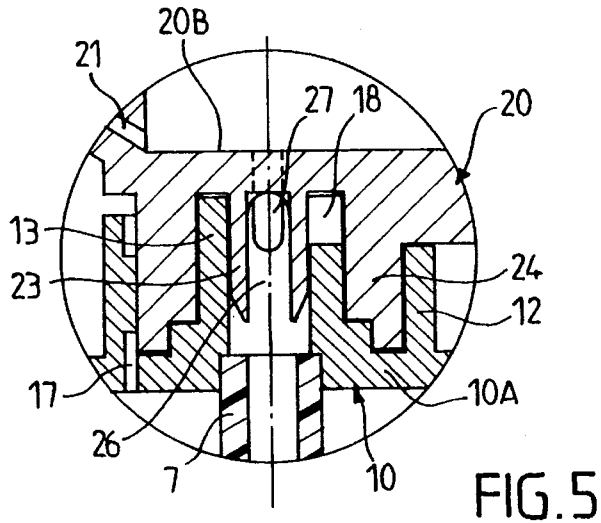
FIG. 5 is similar to FIG. 4, the dispensing head being in the closed position.

FIGS. 3 to 5 show an alternative embodiment of a dispensing assembly according to the invention; this alternative embodiment is of the kind of that described previously, the pieces of which it is composed, which are identical or which act in the same way as those of the previous embodiment bear the same reference; this alternative embodiment differs from the previous embodiment in that it is the rigid bottle 1 which forms the container holding the product to be dispensed; a dip tube 7, connected at its upper part to the internal outer skirt 13 of the support 10, goes down to near the bottom of the bottle 1; at the upper part of the bottle, means are provided for venting to atmosphere the upper volume of the bottle 1 located above the product which it contains; these atmosphere-venting means are formed by an axial groove 17 provided in the inner surface of the external outer skirt 12 of the support 10 and emerging into the bottle 1, and by another axial groove 28 provided in the outer surface of the outer tubular part 24 of the dispensing head 20 and emerging on the outside of the bottle 1 the position of the axial grooves 17 and 28 is such that venting to atmosphere takes place, or does not take place, depending on whether the communication between the chamber 50 and the bottle 1 is open (FIG. 4) or closed (FIG. 5).

Figure 6:
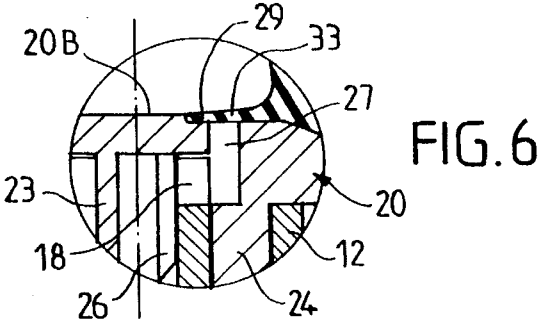
FIG. 6 is a partial view of FIG. 4 showing an alternative embodiment for the inset of the inlet valve.

According to FIG. 6, the suction valve 33 is placed in a rabbet 29 provided in the surface of the bottom 20B; the rabbet 29 has a shape corresponding to that of the valve 33 and provides better transverse retention of the said valve 33, thereby increasing its lifetime.

Figure 7:
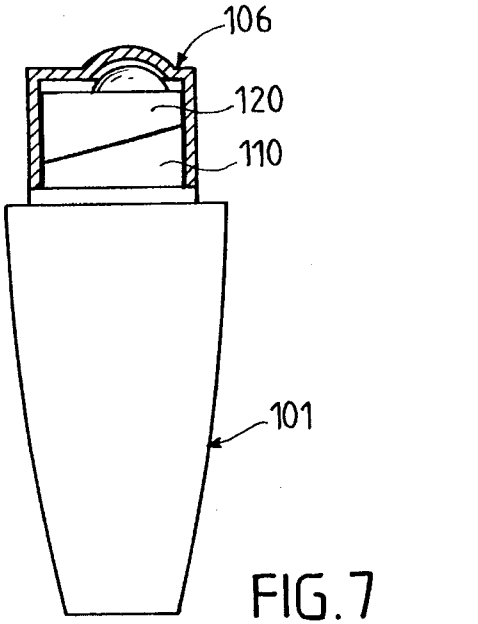
FIG. 7 is an elevation view of another dispensing assembly according to the invention in the configuration which it possesses during storage.
Figure 8:
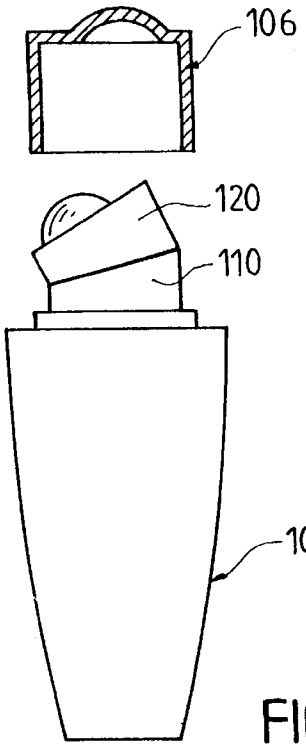
FIG. 8 depicts the assembly of FIG. 7 in the configuration which it possesses for dispensing the product.

Of course, the correct behaviour over time of the product contained in the container of the dispensing assemblies which have just been described requires that the user, after use, rotates the dispensing head 20 with respect to the support 10 in order to close the communication between the container and the chamber 50; this operation is not natural, as is the case consisting in placing the overcap 6 onto the bottle 1; the alternative embodiment of FIGS. 7 and 8 shows a dispensing assembly endowed with a polarizing function allowing the overcap to be placed only if the abovementioned communication is closed; for this purpose, the bottle 101 bears a support 110 of a dispensing head 120 mounted so as to rotate on the support 110 in a plane which is inclined with respect to the axis of the bottle 101; in the position of the head 120, illustrated in FIG. 7, for which the said communication is closed, the support 110 and the head 120 have matching cylindrical outer contours allowing a perfectly cylindrical overcap 106 to be put into place; as may be seen in FIG. 8, in the dispensing position, the axes of the support 110 and the head 120 make an angle between them and it is not possible to put the overcap 106 onto the assembly; in this dispensing position, it should be noted that, with the user holding the bottle 101, dispensing of the product is facilitated.

It should be noted that the ring 40 may be made of overinjection of a rigid material onto the flexible diaphragm 30.

I claim:

1. Assembly for dispensing a liquid to pasty product, which includes a container (1, 8, 101) holding the product, a dispensing head (20, 120) having a dispensing channel (21), a flexible diaphragm (30) possessing a part in the form of a dome (32) which defines, in the dispensing head (20, 120), a variable-volume compression chamber (50) in communication with the container (1, 8, 101), an inlet valve (133) being placed in this communication and allowing the product to pass only from the container (1, 8, 101) to the compression chamber (50), the said compression chamber (50), the inlet valve (33) and a dispensing valve constituting a pump for dispensing product, the said flexible diaphragm (30) being held against the dispensing head (20, 120) by a fixing element consisting of a ring (40) possessing an opening (42) from which the compression dome (32) of the flexible diaphragm (30) emerges, characterized in that the ring (40) bears an annular projection (41) surrounding the said opening (42), the dispensing head (20, 120) being provided with an annular groove (25) receiving an annular groove (34) which the flexible diaphragm (30) possesses and which surrounds the compression dome (32) of the flexible diaphragm (30), the annular projection (41) of the ring (40) being inserted into the annular groove (34) of the flexible diaphragm (30).

2. Assembly according to claim 1, characterized in that the inlet valve (33) is advantageously moulded as a single piece with the flexible diaphragm (30).

3. Assembly according to claim 1, characterized in that a closure system is located at the terminal part, which opens onto the outside, of the dispensing channel (21), the said closure system consisting of a seat (20A) and of a springy leaf (31) at least partially in contact with the seat (20A) when there is no dispensing, moving away at least partially from the said seat (20A) by flexing perpendicularly to the said seat (20A) under the pressure of the product to be dispensed and coming back, by elasticity, into its initial position when the dispensing ceases.

4. Assembly according to claim 3, characterized in that the springy leaf (31) is moulded as a single piece with the flexible diaphragm (30).

5. Assembly according to claim 3, characterized in that the dispensing valve is constituted by the closure system.

6. Assembly according to claim 1, characterized in that the dispensing head (20, 120) is mounted so as to rotate between at least two positions, a position in which a communication between the compression chamber (50) and the container (1, 8, 101) is closed and a position in which the said communication is open.

7. Assembly according to claim 6, characterized in that it comprises a rigid bottle (1, 101) to which a support (10, 110) is fixed, the dispensing head (20, 120) being rendered axially integral with the said support (10, 110) and free to rotate with respect to it.

8. Assembly according to claim 7, characterized in that the support (10, 110) possesses an internal cylindrical outer skirt (13) housed in a sealed manner in the annular space lying between an internal tubular part (23) and an external tubular part (24) which the dispensing head (20, 120) possesses.

9. Assembly according to claim 6, characterized in that a port (18) passes through the wall of the internal cylindrical outer skirt (13) of the support (10, 110), the internal (23) and external (24) tubular parts of the dispensing head (20, 120) being respectively provided with a longitudinal slot (26) and with a passage (27), these facing each other, the passage (27) emerging into the compression chamber (50) and being able to be closed off by the inlet valve (33), the internal cylindrical inner skirt (13) of the support (10, 110) and the internal tubular part (23) of the dispensing head (20, 120) communicating with the container (1, 8, 101), the longitudinal slot (26) and the passage (27) being placed so as to face the port (18) in that position of the dispensing head (20, 120) with respect to the support (10, 110) for which the communication between the compression chamber (50) and the container (1, 8, 101) is open.

10. Assembly according to claim 8, characterized in that the container (8) is a flexible bag housed inside the rigid bottle (1, 101) and rendered integral, in a sealed manner, with a sleeve (19) prolonging the internal cylindrical outer skirt (13) of the support (10, 110) towards the inside of the bottle (1, 101), the bottom of the rigid bottle (1, 101) including an air-uptake orifice (3).

11. Assembly according to claims 8, characterized in that the container is the rigid bottle (1, 101) and the assembly comprises a dip tube (7) going down to near the lower part of the rigid bottle (1, 101) and being connected, at its upper part, to the internal cylindrical outer skirt (13) of the support (10, 110).

12. Assembly according to claim 1, characterized in that the ring (40) is made of overinjection of a rigid material onto the flexible diaphragm (30).

* * * * *